US005692942A

United States Patent [19]

Hill

[11] Patent Number: 5,692,942

[45] Date of Patent: Dec. 2, 1997

[54] DISPLAY FORMING METHOD

[75] Inventor: Russell J. Hill, El Cerrito, Calif.

[73] Assignee: The BOC Group, Inc., New Providence, N.J.

[21] Appl. No.: 565,741

[22] Filed: Nov. 30, 1995

[51] Int. Cl.[6] ..... H01J 9/02

[52] U.S. Cl. ..... 445/22; 445/24

[58] Field of Search ..... 445/22, 24; 313/309

[56] References Cited

U.S. PATENT DOCUMENTS

| | | | |
|---|---|---|---|
| 3,665,241 | 5/1972 | Spindt et al. | 313/309 X |
| 5,181,874 | 1/1993 | Sokolieh et al. | 445/24 |
| 5,209,687 | 5/1993 | Konishi | 445/24 X |

*Primary Examiner*—Kenneth J. Ramsey
*Attorney, Agent, or Firm*—David M. Rosenblum; Salvatore P. Pace

[57] ABSTRACT

A method of forming a display in which first and second substantially flat display substrates are positioned in the juxtaposed relationship with a release agent located between the first and second display substrates. The first and second substrates are then slumped into a spherical configuration. The first and second substrates are separated and cleaned and an electronically activated display elements are formed on the conforming inner concave and convex surfaces of the first and second substrates so that images produced by the display elements can be viewed from the concave surface of the second substrate. The display elements can be field emission display elements in part produced by electron beam evaporation methods in which a source to substrate distance is set by a spherical radius of the substrates. After the formation of the field emission display elements, the first and second substrates repositioned and connected to one another with a peripheral vacuum seal sealing the display elements therebetween. A region located between the first and second display substrates and within the peripheral vacuum seal is evacuated.

6 Claims, 2 Drawing Sheets

DISPLAY FORMING METHOD

BACKGROUND OF THE INVENTION

The present invention relates to a method of forming a display in which first and second substrates are slumped in a furnace to a configuration conforming to a segment of a sphere and electronically activated display elements are formed between the substrates to provide a concave viewing surface. More particularly, the present invention relates to such a method and display in which the electronically activated display elements comprise field emission display elements.

There are a variety of electronically activated displays such as active matrix displays, liquid crystal displays and field emission displays. Generally, such displays are formed between two flat substrates in which one of the substrates is transparent to allow displayed images to be viewed.

Field emission displays are formed by first applying a conductor layer, such as amorphous silicon, to a substrate. An insulator layer, formed of silicon dioxide, is applied directly on top of the conductor layer. Vias are formed within the conductor and insulator layers by etching processes. Thereafter, an aluminum or nickel lift-off layer is deposited on top of the insulator layer by a low angle deposition technique. Spindt emitters are formed within the vias during an orthogonal deposition effected through electron beam evaporation. An acid bath is used to dissolve the lift-off material and to remove excess emitter material. A phosphorescent layer is formed on an opposing substrate. The phosphorescent layer can be monochromatic or can consist of repeating bands of primary colors that will emit visible light when bombarded by electrons produced by the Spindt emitters. In such manner, a display can be viewed by an observer.

The problem with all flat screen displays, such as have been discussed above, is that glare can reduce the effectiveness of the display. Additionally, flat glass displays tend to be fragile structures which easily deform. Since display elements are preserved at low atmospheric pressure, display flexure after pump out is another problem which is particularly a problem in larger displays.

Field emission displays have unique fabrication problems. For instance, it is difficult to form large field emission displays because the orthogonal deposition must be conducted at a source to substrate distance that will produce a deposition angle that is less than the specified maximum deposition angle. If the maximum deposition angle is exceeded, then, the Spindt emitters will be malformed and therefore, non-functional. Generally speaking, the larger the display, the larger the source to substrate distance and hence, the greater the fabrication costs. Also, such displays tend to be labor intensive in that the panels are individually fabricated. In fact, in order to prevent flexure of the substrates due to size or pump-out, spacers are placed between substrates. However, placement of such spacers decreases the brightness of the display.

As will be discussed, the present invention provides a display that is less susceptible to reflection and glare and that is particularly suited to being formed with field emission display elements.

SUMMARY OF THE INVENTION

The present invention provides a method of forming a display in which first and second substantially flat display substrates are positioned in a juxtaposed relationship with a release agent located between the first and second display substrates. The first and second substrates are heated in a furnace so that the first and second substrates slump to a configuration conforming to a segment of a sphere. The segment of the sphere has conforming inner concave and convex surfaces of the first and second substrates, respectively, and an outer concave surface of the second substrate. The first and second substrates are separated and cleaned and electronically activated display elements are formed on the conforming inner concave and convex surfaces of the first and second substrates so that images produced by the display elements can be viewed from the concave surface of the second substrate. The first and second display substrates are repositioned in the juxtaposed relationship and connected to one another with a peripheral vacuum seal sealing the display elements therebetween. A region located between the first and second substrates is evacuated within the peripheral seal.

In accordance with another aspect of the present invention, a method of forming a display is provided that comprises the following steps. In step A: first and second substantially flat display substrates are positioned in a juxtaposed relationship with a release agent located between the first and second display substrates. In step B, the first and second display substrates are heated in a furnace so that the first and second substrates slump to a configuration conforming to a segment of a sphere having conforming inner concave and convex surfaces of the first and second substrates, respectively, and an outer concave surface of the second substrate. The first and second display substrates are separated and cleaned and field emission display elements are formed on the conforming inner concave and convex surfaces of the first and second substrates in a step D. Step D comprises a step D-1 that consists of forming a field emission display substrate on the concave surfaces of the first substrate. In a step D-2, steps A through D-1 are repeated so that a plurality of field emission display substrates are formed. In a step D-3, Spindt emitters are formed on the plurality of field emission display substrates by an electron beam evaporation process having the field emission display substrates rotated while being mounted within a rotatable dome substrate carrier. An electron beam evaporation source is located a distance from the plurality of field emission display substrates that is equal to about a radius of the sphere. In step D-4, a phosphorescent layer is formed on the convex surface of the second display substrate. In step E, the first and second display substrates are repositioned in the juxtaposed relationship. Thereafter, in step F, the first and second substrates are connected to one another with a peripheral vacuum seal sealing the display elements therebetween. A region located between the first and second display substrates is evacuated within the peripheral seal.

In still a further aspect, the present invention provides a display comprising first and second display substrates positioned in a juxtaposed relationship to one another and having a configuration conforming to a segment of a sphere including conforming, inner concave and convex surfaces of the first and second substrates, respectively, and an outer concave surface of the second substrate. Electronically activated display elements are formed on the conforming inner concave and convex out surfaces of the first and second substrates so that images produced by the display elements can be viewed from the concave surface of the second substrate. A means is provided for connecting the first and second substrates to one another with a peripheral vacuum seal sealing the display elements therebetween.

In all embodiments of the present invention, since the viewing surface is concave, there is less problem with glare than in prior art flat screen displays. In fact, a display in accordance with the present invention can provide a wrap-around viewing. Since the display requires evacuation, a spherical geometry reduces flexure of the display and potential distortion. The small curvature of the finished display can provide tempering or strengthening of the glass. With respect to that aspect of the present invention that involves the utilization of field emission displays, large displays can be processed with shorter source to substrate distances. For instance, if one were to form a 50.8 cm. flat display with a maximum allowed deposition angle of about five degrees, the source to substrate distance would be approximately 290.32 cm. This is to be contrasted with a 50.8 cm. diagonal curved display with a 2.54 cm. offset from curvature that allows a source to substrate distance of approximately 128.27 cm. to be utilized. The reason for this is that for a spherical substrate surface, a 90 degree deposition angle can be maintained by simply positioning the electron beam evaporation source at a distance equal to about the spherical radius of the display. As will be discussed, further efficiencies can be realized by forming Spindt emitters on several displays at one time using a rotating dome substrate holder in which an electron beam evaporation source is situated with a center of the radius of the dome.

BRIEF DESCRIPTION OF THE DRAWING

While the specification concludes with claims distinctly pointing out the subject matter that applicants regard as their invention, it is believed that the invention will be better understood when taken in connection with the accompanying drawings in which:

DETAILED DESCRIPTION

Figure 1:
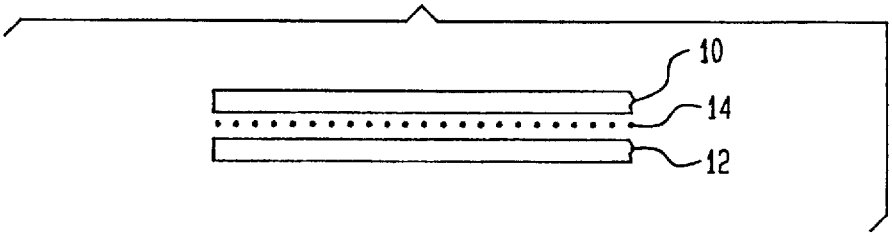
FIGS. 1 through 4 are schematic illustrations of the first four sequential steps in forming a display in accordance with the present invention.

With reference to FIG. 1, first and second substantially flat display substrates 10 and 12 are positioned in a juxtaposed relationship with a release agent 14 located between first and second display substrates 10 and 12. First and second display substrates 12 are fabricated from glass with at least second display substrate 12 being transparent. The release agent 14 preferably comprises talcum powder.

Figure 2:
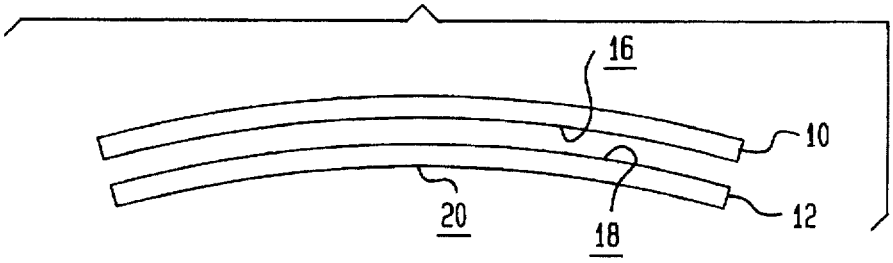
Figure 3:
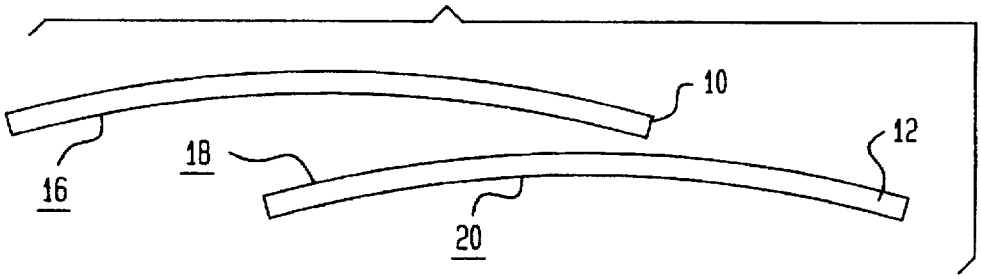

As represented in FIG. 2, first and second substrates 10 and 12 are heated in a furnace over a mold (not shown but known in the art) so that first and second substrates 10 and 12 slump into a configuration conforming with a segment of the sphere. The sphere has inner concave and convex surfaces 16 and 18 of first and second display substrates 10 and 12. Outer concave display surface 20 is provided on second display substrate 12. On exit from the glass furnace, first and second display substrates 10 and 12 are tempered or toughened as required. As illustrated in FIG. 3., first and second display substrates are then separated.

Figure 4:
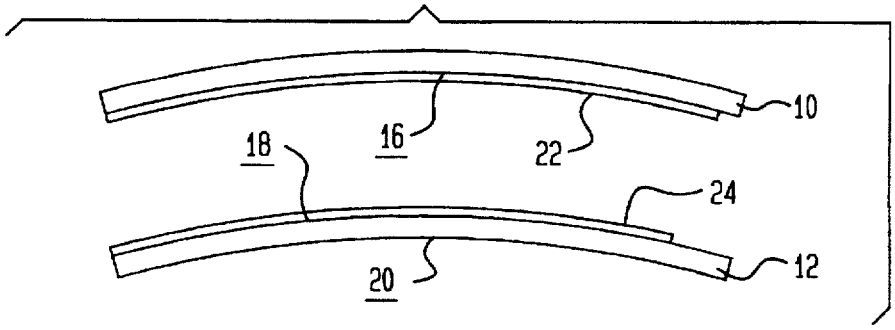
Figure 4A:
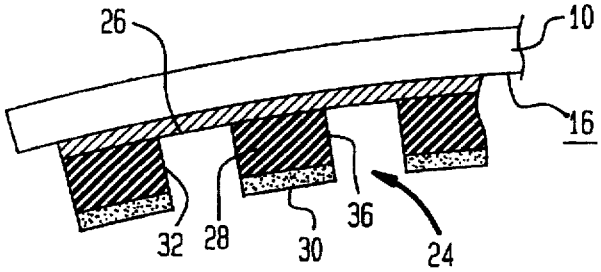
FIG. 4A is a field emission display substrate formed through the foregoing four steps.

With reference to FIGS. 4 and 4A, a field emission substrate 22 is formed on first display substrate 10. On second display substrate 12, a phosphorescent coating 24 is applied. Field emission substrate 22 consists of a conductor layer 26, an insulator layer 28 of silicon dioxide formed on top of conductor layer 26, a lift-off layer of nickel 30 applied to insulator layer 28 by low angle deposition techniques. Active ion etching produces vias 32 and 36 that penetrate insulator layer 28 and lift-off layer 30.

Figure 5:
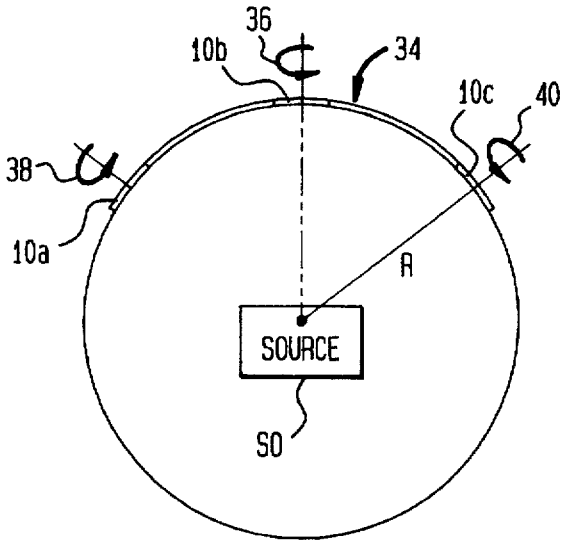
FIGS. 5 and 5A dramatically illustrate a method of forming field emission display substrates with Spindt emitters through the use of a rotating dome substrate holder.
Figure 5A:
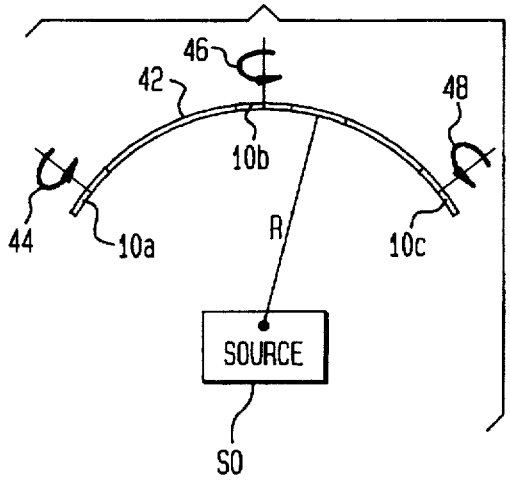

With reference to FIG. 5, Spindt emitters are formed. Prior to this, however, the steps illustrated in FIGS. 1 through 4 can be repeated so that a plurality of first display substrates are produced having field emission display substrates formed thereon. The first display substrates, illustrated by reference numerals 10A, 10B and 10C, are held within a rotating dome substrate holder 34 which rotates as indicated by arrowhead 36. The planetary display substrates 10B and 10C also rotate as indicated by arrowheads 38 and 40. As illustrated in FIG. 5A, it is possible for a doomed substrate holder 42 to be constructed for mounting first display substrates 10A, 10B and 10C. In such embodiment only first display substrates 10A, 10B and 10C rotate as indicated by arrowheads 44, 46 and 48 and not domed substrate holder 42 itself. In either embodiment, an electron beam evaporation source 50 is situated at a source to substrate distance equal to a spherical radius of first display substrates 10A, 10B and 10C to effect an orthogonal deposition of chromium to form Spindt emitters.

Figure 6A:
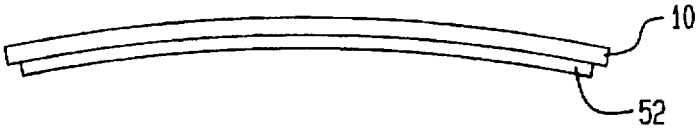
FIG. 6A is the product of the orthogonal deposition formed by either of the methods shown in FIGS. 5 and 5A.
Figure 6B:
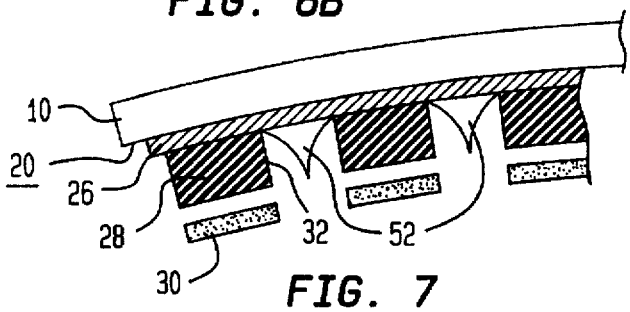
FIG. 6B is an enlarged fragmentary view of the FIG. 6A.
Figure 7:
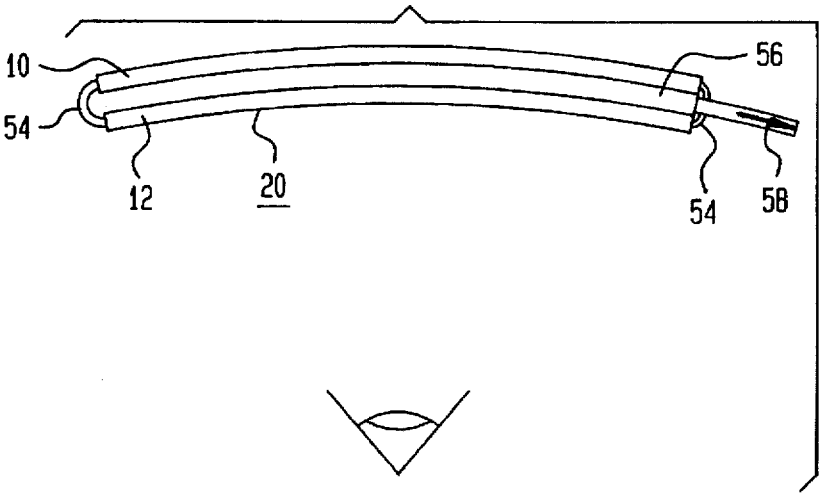
FIG. 7 is a schematic view of a finished display in accordance with the present invention.

With reference to FIG. 6A and 6B, a first substrate 10 is illustrated. First substrate 10 has SPINDT emitters 52. An acid bath is used to remove excess Spindt emitter forming material and lift-off layers 30. With reference to FIG. 7, first and second display substrates 10 and 12 are then repositioned in a juxtaposed relationship and are peripherally connected to one another with a vacuum seal 54 peripherally sealing the display elements therebetween. A region 56 located between the peripheral vacuum seal 54 is evacuated by means of a pinch-off tube 58 which is subsequently sealed. Images on the display can then be viewed from concave viewing surface 20 of second display substrate 12.

While the present invention has been described with referenced to preferred embodiment, as will occur to those skilled in the art, numerous changes, additions, and omissions may be made without departing from the spirit and scope of the present invention.

I claim:

1. A method of forming a display comprising:

positioning first and second substantially flat display substrates in a juxtaposed relationship with a release agent located between said first and second display substrates;

heating said first and second substrates in a furnace so that said first and second substrates slump to a configuration conforming to a segment of a sphere having conforming inner concave and convex surfaces of said first and second substrates, respectively, and an outer concave surface of said second substrate;

separating and cleaning said first and second substrates;

forming electronically activated display elements on said conforming inner concave and convex surfaces of said first and second substrates so that images produced by said display elements can be viewed from said concave surface of said second substrate;

repositioning said first and second display substrates in said juxtaposed relationship;

connecting said first and second substrates to one another with a peripheral vacuum seal sealing said display elements therebetween; and evacuating a region located between said substrates and within said peripheral vacuum seal.

2. The method of claim 1, wherein:

said electronically activated display elements comprise a field emission display;

a field emission display substrate is formed on said concave surface of said first substrate;

Spindt emitters are formed on said field emission display substrate by an electron beam evaporation process having an electron beam evaporation source located a distance equal to about a radius of said sphere; and a phosphorescent layer is formed on said convex surface of said second substrate.

3. The method of claim 2, wherein said first substrate is rotated during formation of said Spindt emitters.

4. The method of claim 2, wherein:

said first and second substrates are formed of glass; and after said first and second substrates are removed from said furnace said first and second substrates are tempered.

5. A method of forming a display comprising the steps of:

a) positioning first and second substantially flat display substrates in a juxtaposed relationship with a release agent located between said first and second display substrates;

b) heating said first and second substrates in a furnace so that said first and second substrates slump to a configuration conforming to a segment of a sphere having conforming inner concave and convex surfaces of said first and second substrates, respectively, and an outer concave surface of said second substrate;

c) separating and cleaning said first and second substrates;

d) forming field emission display elements on said conforming inner concave and convex surfaces of said first and second substrates by:

d-1) forming a field emission display substrate on said concave surface of said first substrate;

d-2) repeating steps a) through d-1 inclusive so that a plurality of field emission display substrates are formed;

d-3) forming Spindt emitters on said plurality of field emission display substrates by an electron beam evaporation process having said field emission display substrates rotated while mounted within a rotating dome substrate carrier and an electron beam evaporation source located at a distance from said plurality of field emission display substrates equal to about a radius of said sphere; and d-4) forming a phosphorescent layer on said convex surface of said second display substrate;

e) repositioning said first and second display substrates in said juxtaposed relationship;

f) connecting said first and second substrates to one another with a peripheral vacuum seal sealing said display elements therebetween; and g) evacuating a region located between said substrates and within said peripheral vacuum seal.

6. The method of claim 5, wherein each of said plurality of field emission display substrates is rotated while mounted within said rotating dome substrate carrier.

* * * * *